United States Patent [19]

Bond

[11] 4,323,641

[45] Apr. 6, 1982

[54] PHOTOGRAPHIC IMAGE ENHANCEMENT BY A GOLD-TONING NEUTRON-ACTIVATION PROCESS

[75] Inventor: Clarence D. Bond, Alexandria, Va.

[73] Assignee: The United States of America as represented by the Secretary of the Navy, Washington, D.C.

[21] Appl. No.: 178,330

[22] Filed: Aug. 15, 1980

[51] Int. Cl.[3] ..... G03C 7/00

[52] U.S. Cl. ..... 430/370; 430/16; 430/373; 430/414; 430/432; 430/953

[58] Field of Search ..... 430/9, 16, 17, 370, 430/373, 363, 413, 432, 953, 414

[56] References Cited

U.S. PATENT DOCUMENTS

| | | | |
|---|---|---|---|
| 2,407,381 | 9/1946 | Pecher | 430/644 |
| 2,575,002 | 11/1951 | Carroll | 430/425 |
| 2,603,755 | 7/1952 | DeMent | 430/17 |
| 3,852,072 | 12/1974 | Gerber et al. | 430/605 |
| 4,085,331 | 4/1978 | Thackray | 430/432 |
| 4,137,461 | 1/1979 | Murray | 430/199 |

*Primary Examiner*—J. Travis Brown

*Attorney, Agent, or Firm*—Richard S. Sciascia; William T. Ellis; Kenneth E. Walden

[57] ABSTRACT

A gold-toning neutron-activation process for intensifying or amplifying the contrast in extremely weak images in photographic negatives where the exposure level may be as low as 1.5% of optimum. The method involves three main steps: (a) gold toning of the silver image on the negative; (b) neutron activation of the gold image to produce radioisotopes; and (c) transferring the image to an unexposed autoradiographic film as the ionizing radiation from the radioactive gold exposes the film to produce intensification of the contrast.

3 Claims, No Drawings

PHOTOGRAPHIC IMAGE ENHANCEMENT BY A GOLD-TONING NEUTRON-ACTIVATION PROCESS

BACKGROUND OF THE INVENTION

The present invention relates to the enhancement of photographic images and in particular to the enhancement of commercial silver halide film utilizing a gold-toning neutron-activation process.

Contrast enhancement of photoreconnaissance and intelligence films is desirable since it allows the recovery of image information which may be taken under adverse lighting or obscured in the shadows and which might otherwise be lost by conventional methods using chemical/photographic or denistometer/computer techniques. Such a process can also be extremely valuable in the enhancement of weak images in other disciplines that use photographic film as detectors, e.g., low intensity spectroscopy, faint images in astronomy, and radiation dose reduction in diagnostic medical x-rays by reduction of required exposure.

When standard commercial silver halide film is underexposed and chemically developed with resulting atomic silver concentration of less than or equal to $10^{-5}$ gram/cm$^2$, ordinary chemical enhancement and light transmission techniques are inadequate for satisfactory image formation. An image-silver density of $10^{-5}$ gram/cm$^2$, however, can still contain a large amount of information (i.e., about $10^7$ silver-grains/cm$^2$). Several nuclear and ion beam techniques can detect silver in light substrates in the $10^{-6}$ to $10^{-9}$ gram/cm$^2$ range which is well below normal optical densitometer sensitivity. However, this sensitivity is not fully utilized because presently all contrast enhancement techniques, whether by nuclear or computer methods, reach a limiting condition imposed by the grain statistics and signal to noise ratio as the image density approaches the level of fog, i.e. the non-image fog which development produces an all sensitive films and which obscures images of lower density. Generally all of the present nuclear enhancement techniques employ some procedure for causing the silver grains in the photographic negative to emit charged particles or other ionizing radiation. The intensity of the induced activity is proportional to the density of the silver image. Both radiochemical toning and direct neutron activation have been used to make the silver grains emit electrons. In such techniques the radioactive image can be rendered visible and enhanced by placing the activated film in pressure contact with a new unexposed film which is exposed by the ionizing radiation rather than light (i.e., contact autoradiography). Thus the electrons from each grain in the original weak image can be made to cause numerous grains to be made developable in the autoradiograph thereby creating an amplification or enhancement mechanism.

The radiochemical toning techniques can be quite hazardous and require trained radiochemists. Typically the autoradiographic exposure times require seven to eighty hours. Direct neutron activation of the silver image, without toning, has several disadvantages. The principle difficulty is that the two silver isotopes which are produced by neutron activation have half-lives that are either inconveniently short (2.4 min.) for easy reproducible control of exposure or inconveniently long (252 days) for easy exposure. Furthermore, photographic materials such as gelatine are rapidly damaged by radiolysis and they can be left in a high flux reaction for only very short periods. While it is possible to achieve saturation activity of the short-lived isotope 108 Ag, only a small amount of $^{110m}$Ag can be formed before the photograph is damaged. If time is no object, good autoradiographs can be obtained from this low level of $^{110m}$Ag activity, but normally the short-lived isotope is used because of time restraints. In a technique utilizing the short-lived isotopes, irradiation of low density photographs at a thermal neutron flux of $7\times10^{12}$ neutrons/cm$^2$/sec for 5 minutes followed by a cooling period of two minutes and autoradiographic exposure of 10 seconds has given dense autoradiographs, but the procedure is inconveniently hasty and estimation of the correct autoradiographic exposure is difficult.

Thackray has disclosed, in an Australian Pat. No. 422872, a silver iodide conversion process followed by neutron activation which partially eases some of the constraints of direct neutron activation of the silver. However, the process requires a forty minute neutron exposure and is effective for producing autoradiographs for only two or three hours due to the short twenty-five minute half-life of the $^{128}$I. (This generally means that the autoradiography must be carried out at the site of the reactor facility.) By contrast the gold-toning neutron-activation process of the present invention employs a stable chemically inert gold plating of the individual silver grains. Because of the unique neutron activation properties of gold, the subsequent neutron activation requires only five minutes and produces a radioisotope $^{198}$Au which has a 2.7 day half-life that allows autoradiography to be carried out for 7 to 10 days. Further the gold toning, being chemically inert, renders the image substantially impervious to environmental deterioration while leaving the visual tone quality unchanged and reusable. Moreover, the short thermal neutron activation period produces no detectable damage to the films.

Furthermore, instead of electron emission, the silver grains have also been made to emit heavy fission fragments by radiochemical toning with californium (spontaneous fission) and by uranium toning with fission by photon or neutron irradiation (induced fission). This technique requires a glass plate in pressure contact with the original toned film. Here, the fission fragments produce damage track in the glass plate. In order to render the image visible, the glass plate is developed in an etching solution. The fission track enhancement process is a considerably more involved technique requiring fairly precise control of etching and specialized printing. The degree of enhancement or amplification is not readily controllable since the etching process is irreversable. Further, the intense photon irradiation used, severely damages and alters the original film.

OBJECTS OF THE INVENTION

An object of this invention is to provide a safe and convenient method of enhancing photographic images which results in enhancing contrast levels roughly 3–5 times from negatives having exposure levels as low as 1.5% of the optimum.

A further object of this invention is to provide a method of enhancing photographic images which eliminates all handling of radioactive solutions and the associated hazards.

Another object of this invention is to provide a nuclear method of enhancing photographic images wherein the radioisotopes created have a half-life sufficient for convenient exposure time yet short enough so as to alleviate the hazards of prolonged radiation.

Still another object of this invention is to provide a method of enhancing photographic images which has the capability of providing multiple autoradiographs from original negatives and which does not do detectable radiation or chemical damage to the original film or which otherwise renders the film unusable.

Yet another object of this invention is to provide a method of enhancing photographic images which does not involve exposure to $\gamma$ rays, x-rays, charged particles or other radiation which damages the original film.

Other objects, advantages, and novel features of the present invention will become apparent from the detailed description of the invention, which follows the summary.

SUMMARY OF THE INVENTION

The gold-toning neutron-activation process of the present invention differs significantly from the previously described nuclear methods of photographic image enhancement in two important ways. Firstly, a nonradiochemical toning solution and complexing wash are used to gold plate the image silver grains (i.e. toning) before activation. This procedure eliminates all hazards of handling radioactive solutions. Secondly, the neutron activation of the gold image is far superior to either direct activation of the silver image or radiochemical toning of the silver image both with regard to the efficiency of image activation and the speed and ease of producing autoradiographs. To begin the preferred method of the present invention, the photographic negative is placed in a gold chloride and ammonium thiocyanate toning solution in which the gold is plated onto the silver grains of the image. Next the film is washed in an ammonium thiocyanate complexing solution to remove any excess non-image gold deposited in the emulsion. The film is then placed in a neutron beam to activate the film. Neutrons captured by the gold and silver components of the image produce radioisotopes $^{198}$Au, $^{108}$Ag, and $^{110}$Ag. After cooling for about one hour the $^{108}$Ag dissipates. The $^{198}$Au has a half-life of 2.69 days and is the dominant beta-ray active component. An intensified reproduction of the beta active gold component image is obtained by placing the film in pressure contact with an unexposed autoradiographic film. The time required ranges from about 5 minutes to about 1 hour if transfer is carried out within a few hours of activation. Longer transfer periods are required after longer time following activation.

DESCRIPTION OF THE PREFERRED EMBODIMENT

The preferred method of the present invention involves three main steps: (a) gold toning of the negative, (b) neutron activation of the gold image and (c) image intensification by autoradiographic reproduction. In order to begin the gold-toning process, the photographic negative, film or equivalent substrate, having thereon a photographic image, is prepared in the following manner. The film or substrate is washed in running demineralized water for 5 minutes to soften the emulsion. The film is then placed in a gold chloride toning solution for 20 minutes with continuous agitation. The toning solution is preferably prepared by adding to the desired amount of distilled water 0.1% by weight gold chloride and 1.0% by weight ammonium thiocyanate. However, other types of toning chemistry in which gold or the equivalent element can also be utilized to plate the silver grains. The choice of gold as the toning element and the subsequent use of thermal neutron activation to produce the isotope $^{198}$Au is preferable to achieve the high efficiency and image quality of the present method. Gold has the following highly desirable properties which are uniquely suited to the process: (1) high neutron activation cross-section of 98 barns; (2) 100% isotopic abundance of $^{197}$Au (i.e. just one isotope); (3) 100% of the $^{198}$Au isotope decays by beta (electron) emission followed by a low energy gamma ray; (4) the $^{198}$Au has a convenient half-life of 2.7 days; (5) the toning chemistry of the silver image is simplistic; and (6) there is a high mass ratio of gold to silver (0.5/1.0) obtainable in the toned image. In principle any other element having similar properties could also be used. However, a fairly careful check of a chart of the nuclides will reveal that gold is rather unique in processing these qualities simultaneously, e.g., some other elements may have higher neutron activation cross-sections such as Indium ($^{116}$In), Samarium ($^{153}$Sm) and Iridium ($^{192}$Ir), but they also have one or more highly undesirable properties in their mode of decay, half-life, energy or isotopic abundance. In general, such elements also have unknown toning chemistry.

Elements having half-lifes of 2–7 days are highly desirable since a period of 2 days permits the photographic film to be mailed or transported after activation so that developing need not be done at the reactor site. For example, such a process could be carried out aboard a ship by sending the film out to a land based reactor to be activated. Subsequently, the film could be returned to the ship to complete the process of transfer to the second autoradiographic film under controlled conditions. A half-life over seven days is undesirable since the intensity of the radiation is lower. Elements having a high neutron activation cross section; i.e., over 50 Barns, are also desirable since less exposure time to the neutron flux is necessary, thereby minimizing the damage to the film negative.

After toning (i.e., the gold plating of the silver grains), the film is washed in running demineralized water for 5 minutes to rinse off excess toner from the film. Next the film is washed in a gold complexing solution preferably containing ammonium thiocynate (1% by weight) to remove excess gold from the non-silver image portion of emulsion. Generally the film is washed in this solution for 35 minutes with continuous agitation. To complete the gold toning sequence, the film is washed in running demineralized water for 30 minutes and air dried.

The next main step is neutron activation, which is begun by placing the film in a thermal neutron port and irradiating the processed film for 5 minutes utilizing a thermal neutron flux on the order of $10^{13}$ neutron/sec/cm$^2$ that consists roughly of 98% thermal neutrons. Generally the film can be adequately activated in 1–5 minutes with no detectable damage to the emulsion or backing. The neutron capture by the gold and silver components of the image produce the radioisotopes $^{198}$Au, $^{108}$Ag and $^{110}$Ag. The film is allowed to cool for 30 minutes in order to dissipate the non-useful silver (2.42 minute half-life $^{108}$Ag activity). At this point a roll of 20 exposures of 35 mm film of average optical density will have a total $^{198}$Au activity of approximately 4 millicuries or about 200 microcuries per frame. The film's beta active (electron emitting) image is sealed within the emulsion and can be handled by nonspecialized personnel using standard handling precautions for sealed low level sources. The dominant beta-ray active component is the $^{198}Au$ which has a half-life of approximately 2.7 days and 93% of the initial activity will be lost in 10 days. The $^{110}Ag$ has a 252 day half-life and approximately one-thousandth of the activity of the gold.

It should be noted that other means of activation could, in principle, also be used such as gamma-ray irradiation or charged particle activation. These types of activation are less desirable since they generally have much lower activation cross-sections which require more intense irradiation or longer activation times and are likely to result in severe damage to the original film.

The next main step in the preferred method sequence of the present invention is to reproduce the beta-ray active gold image by placing the processed film or substrate in pressure contact with an unexposed autoradiographic film. Generally any film which is capable of being exposed by light is acceptable and x-ray film may also be used to obtain higher optical density. Good results may be obtained using the rapid process Polaroid (trademark) negative type 55-P/N. The two films must have their emulsion surfaces in intimate contact and be under a pressure of approximately 2 lb./in$^2$ in order to obtain good resolution in the reproduction. The exact autoradiograph exposure time required will depend on the optical density of the original image, the level of contrast amplification desired, and on the lapsed time from neutron activation. The average normal times range from 5 minutes to approximately 1 hour if autoradiography is carried out within a few hours of activation. Additional autoradiographs may be produced from the original negatives for several days due to the extended half-life of the gold isotope.

In summary, the key advantages of the preferred method of the present invention are (1) elimination of hazardous radioactive toning solutions; (2) extremely rapid autoradiographic exposure times of 5 minutes to 1 hour (previous exposure times utilizing prior art radiochemical processes ranged from 7 to 80 hours); (3) additional autoradiographs and exposures can be conveniently produced from original negatives for several days for ease of image optimization; (4) no detectable radiation damage to the film; (5) the gold toning process is advantageous to preservation of the silver image while leaving the appearance of the image essentially unchanged; and (6) recovery of useful image information at the 1.5% exposure level which is below the useful sensitivity of present rapid scan computer enhancement methods.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A method of photographic image enhancement on a film for subsequent transfer of the images to another film comprising the steps of:

immersing a developed photographic film containing silver grains dispersed in an emulsion including gelatin molecules in a toning solution of gold chloride and ammonium thiocyanate whereby gold simultaneously plates the silver grains and attaches to the gelatin molecules;

washing the film in a complexing solution of ammonium thiocyanate for substantially removing the gold from the gelatin molecules; and exposing the film to neutron radiation for rendering the gold plating radioactive.

2. The method according to claim 1 further defined by the step of washing the film in demineralized water after toning and prior to washing in the complexing solution.

3. The method according to claim 1 or 2 further defined by immersing the exposed film in a toning solution formulated by adding to a desired amount of distilled water, 0.1% by weight of gold chloride and 1.0% by weight of ammonium thiocyanate.

* * * * *